US005467939A

United States Patent [19]

Georges

[11] Patent Number: 5,467,939

[45] Date of Patent: Nov. 21, 1995

[54] COLLAPSIBLE DRUM

[75] Inventor: Pierre Georges, Clermont-Ferrand, France

[73] Assignee: E M S, Randan, France

[21] Appl. No.: 279,842

[22] Filed: Jul. 26, 1994

[30] Foreign Application Priority Data

Jul. 30, 1993 [FR] France ..... 93 09448

[51] Int. Cl.[6] ..... B65H 75/24

[52] U.S. Cl. ..... 242/607.1

[58] Field of Search ..... 242/607.1, 118.4, 242/571

[56] References Cited

U.S. PATENT DOCUMENTS

| | | | |
|---|---|---|---|
| 1,742,584 | 1/1930 | Daubmeyer et al. | 242/607.1 |
| 1,913,477 | 6/1933 | Daubmeyer et al. | 242/607.1 X |
| 2,425,827 | 8/1947 | Rancourt | 242/118.4 |
| 2,909,340 | 10/1959 | Whitaker . | |
| 3,536,555 | 4/1987 | Dex | 242/607.1 |
| 3,791,606 | 2/1974 | Brown | 242/607.1 |
| 4,066,224 | 1/1978 | Hargreaves et al. . | |
| 5,169,086 | 12/1992 | Vesely | 242/607.1 |

*Primary Examiner*—John M. Jillions
*Attorney, Agent, or Firm*—Griffin, Butler, Whisenhunt & Kurtossy

[57] ABSTRACT

The collapsible drum comprises flange plates associated with a hub made up of hinged elements, each of which comprises two portions having respective ends that face each other and that are connected together, and respective opposite ends that are connected to respective ones of the flange plates via collapsible hinge means, and at least one reinforcing and locking member extending axially inside the hub and providing a resilient link tending to urge the flange plates towards each other.

6 Claims, 3 Drawing Sheets

COLLAPSIBLE DRUM

The present invention relates to a collapsible drum, particularly but not exclusively a drum designed so that electrical cables or optical fiber cables can be wound around it.

BACKGROUND OF THE INVENTION

Known collapsible drums exist. Each such drum comprises flange plates associated with a hub made up of hinged elements, each of which comprises two portions having respective ends that face each other and that are connected together, and respective opposite ends that are connected to respective ones of the flange plates via hinge means formed by hinges so that the portions of each of the hinged elements are substantially in alignment and are substantially perpendicular to the flange plates when the drum is in an in-use position, and so that the portions of each of the hinged elements are collapsed so that they extend along a direction that is substantially parallel to the flange plates when the drum is in a storage position, the portions of the hinged elements being provided with respective side surfaces disposed so as to touch one another in radial planes of the hub when the drum is in the in-use position.

That type of drum offers the advantage of having a collapsed position in which it takes up less space than a conventional rigid-hub drum, and an in-use position in which the side surfaces of the portions of the hinged elements bear against one another so that the forces resulting from winding the cable around the hub are regularly distributed over the side surfaces of the hinged elements. However, while the drum is being handled, either on site or while transporting the drum loaded with cables, the impacts to which the flange plates are subjected cause damage to the hinges so that there is a risk that the collapsible drum might quickly become unusable. In particular in the event of a fall, several hinges breaking simultaneously might render the drum unusable immediately.

OBJECT AND SUMMARY OF THE INVENTION

To mitigate those drawbacks, the invention provides a collapsible drum of the type mentioned above, and provided with at least one reinforcing and locking member extending axially inside the hub and providing a resilient link tending to urge the flange plates towards each other.

In this way, in the event that the flange plates of the drum receive an impact, most of the impact is absorbed by the reinforcing and locking members which keep the flange plates pressed against the ends of the hub, and which minimize the stresses to which the hinge means are subjected.

BRIEF DESCRIPTION OF THE DRAWINGS

Other characteristics and advantages of the invention will appear on reading the following description of different particular embodiments of the invention given with reference to the accompanying drawings, in which.

MORE DETAILED DESCRIPTION

Figure 1:
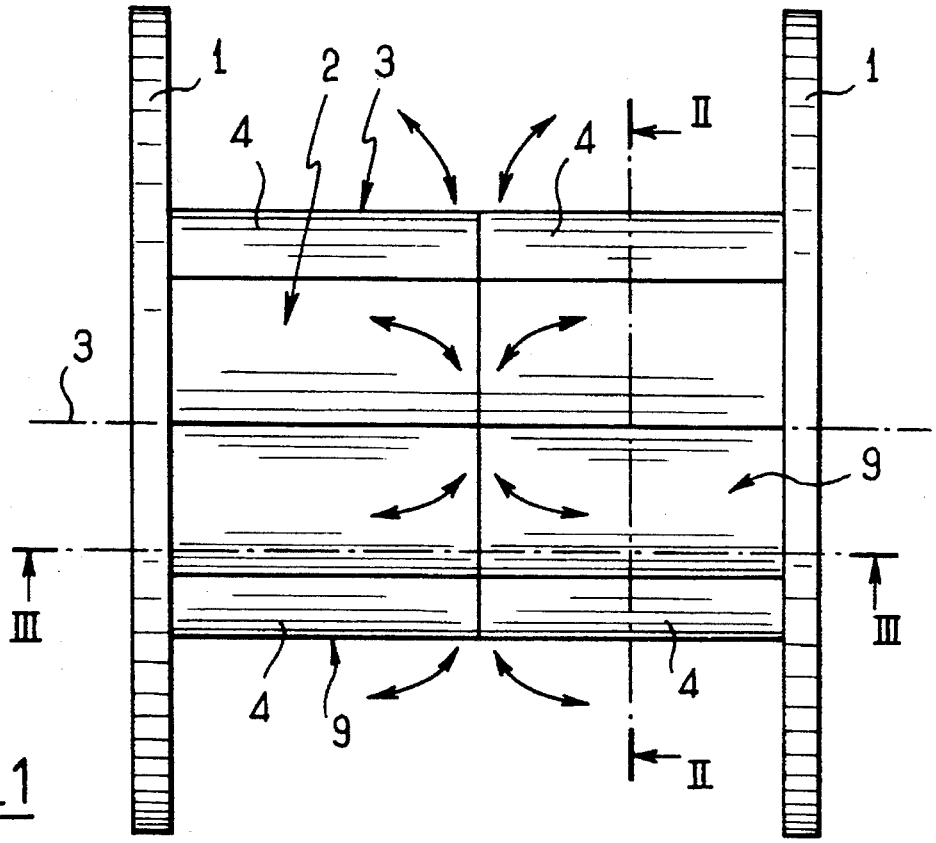
FIG. 1 is an elevation view of a drum of the invention.

With reference to the figures, the drum of the invention comprises two flange plates 1 which support a hub given the overall reference 2.

The hub 2 is made up of hinged elements 3, each of which comprises two portions 4 in the form of bars. The two portions 4 of each hinged element 3 are connected together so that they are hinged like a pair of compasses by hinge means comprising resilient members 5 fixed to the facing ends of the two associated portions 4. The opposite end of each of the portions 4 is connected to a respective one of the flange plates 1 via hinge means comprising resilient means 6.

In the first embodiment, the resilient means 5 and 6 are rubber or elastomer studs, each of which comprises an elongate central body 7 and two hemispherical abutment heads 8 made in one piece with the central body 7, with the plane portions of the hemispherical heads facing the cylindrical central body 7. Each of the portions 4 is hollow and has an outer wall in the shape of a cylinder segment 9, end walls 10 that are perpendicular to a longitudinal direction of the portion 4, and side walls 11 disposed in planes corresponding to radial planes of the hub when the hub is in the in-use position. The flange plates 1 and the end walls 10 of the portions 4 are provided with through orifices 12 (FIG. 5) through which the cylindrical bodies 7 of the rubber studs 5 and 6 extend once each of them has been installed by pushing one of the hemispherical heads through the orifice 12 until it comes out at the other end thereof, so that the plane portions of the hemispherical heads bear against opposite faces of two associated walls.

Figure 3:
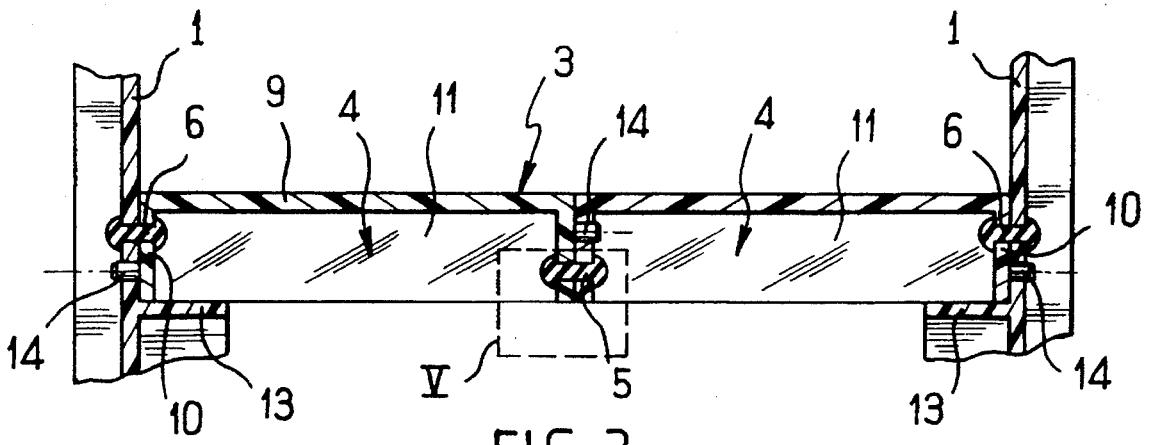
FIG. 3 is a section view of a hinged element and of the adjacent portions of the flange plates on line III—III of FIG. 1 when a first embodiment of the drum of the invention is in the in-use position.
Figure 5:
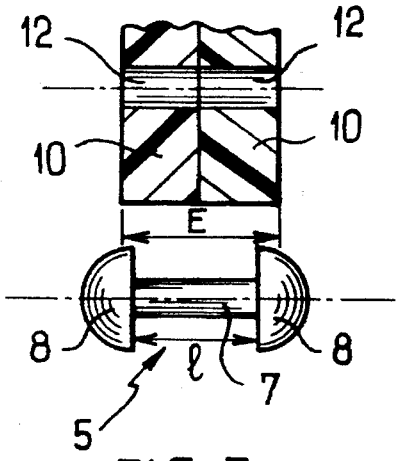
FIG. 5 is an enlarged elevation view of a resilient member, and a corresponding section view of detail V of FIG. 3 before the resilient member is installed.

As shown in FIG. 5, the rest length 1 of the cylindrical body 7 of each of the rubber studs is slightly less than the thickness E of two associated walls so that the cylindrical body 7 is under tension even when two associated portions 4 are in alignment as shown in FIG. 3, so that the end faces of the portions 4 are pressed against each other over their facing surfaces, thereby providing stability for the hinged members 3 when the drum is in the in-use position.

In the preferred embodiment shown, the flange plates 1 are provided with collars 13 projecting into the hub, and the portions 4 are provided with positioning lugs 14 which extend into orifices 15 in the associated walls when the drum is in the in-use position.

The projecting collars 13 are disposed so that those ends of the portions 4 which are adjacent to the flange plates are disposed so as to bear against the collars when the drum is in the in-use position. In this position, the side walls 11 of the portions 4 bear against one another so that the assembly comprising all of the portions 4 makes a vault forming the hub 2 which bears against the projecting collars 13, thereby preventing the hub 2 from slipping relative to the flange plates 1 in a direction that is parallel to the flange plates 1. The positioning lugs 14 which co-operate with the flange plates 1 prevent the hub 2 from slipping relative to the flange plates 1 in a direction that is tangential to the hub 2, thereby preventing the resilient members 6 from being subjected to shear forces both radially and also in a direction that is tangential to the hub 2. In this way, when a cable is wound onto the hub 2, the drum forms a rigid assembly that is capable of supporting the weight of the cable, and if the flange plates of the drum receive an impact, the deformation of the drum is damped by the resilient members without said resilient members being damaged, and the tension of the resilient members that results from the deformation tends to urge the flange plates back into abutment against the end faces of the hub 2.

Figure 4:
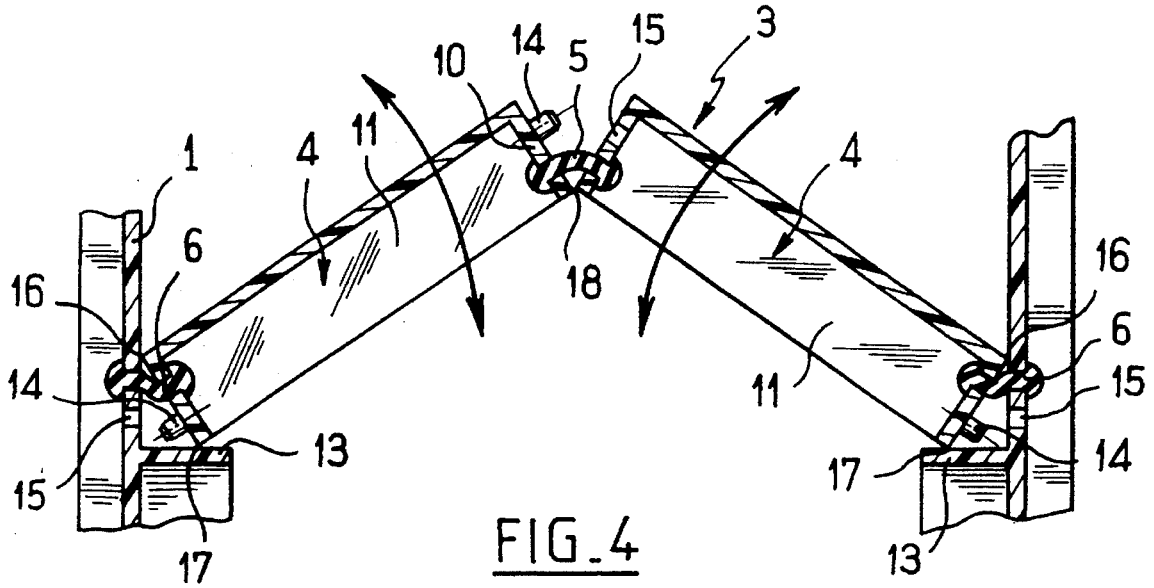
FIG. 4 is a section view that is analogous to FIG. 3, while the drum is being collapsed.

When an empty drum is to be collapsed into its storage position, the flexibility of the resilient members makes it possible to push in one of the hinged elements 3, thereby causing the immediately adjacent hinged elements to project outwardly, and making it possible to grasp one of them and to pull it outwards as shown in FIG. 4. As this is being done, the outward edges 16 of those ends of the portions 4 which are adjacent to the flange plates bear against the flange plates 1 while the inward edges 17 bear against the collars 13, and the inward edges 18 of the facing ends of the portions 4 bear against one another so as to enable the portions 4 to be pivoted until they reach a storage position in which they extend in a direction that is parallel to the flange plates.

In the storage position (not shown in the figures), the central portions of the resilient members extend parallel to the end walls of the corresponding portions 4, and they exert a force thereon that tends to press the portions 4 against the flange plate 1. In this way the drum is maintained in metastable equilibrium in the storage position. To put it back into the in-use position, the flange plates 1 merely have to be pulled apart until the portions 4 tip back into the in-use position by themselves.

Figure 6:
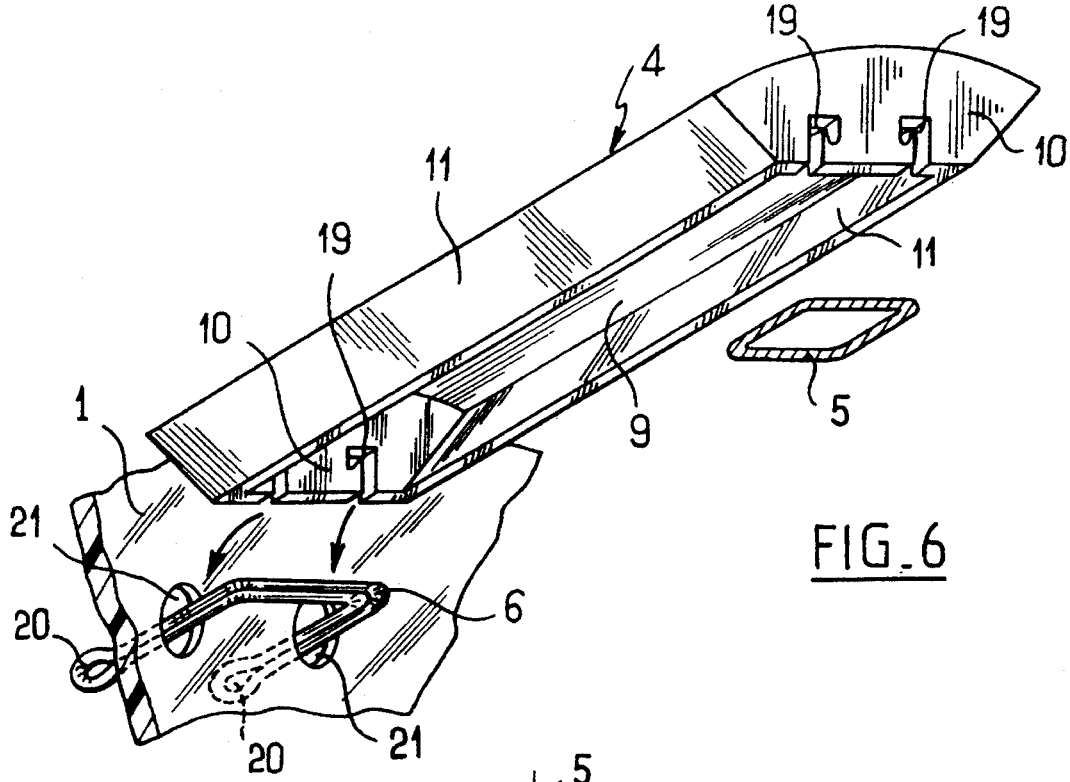
FIG. 6 is a perspective view of a portion of a hinged element, and of the corresponding resilient members in a second embodiment of the invention.

FIG. 6 shows another embodiment in which the resilient members 5 and 6 comprise rubber rings. In this embodiment, the end walls 10 of the portions 4 are provided with notches 19. In the embodiment shown, each rubber ring 5 that unites two facing ends of the portions 4 is engaged in the notches 19 while being kept annular in shape, whereas each ring 6 that unites one end of a portion 4 with a flange plate 1 is folded back on itself, the two touching lengths of ring being engaged in the notches 19 of a portion 4, whereas the loop-shaped ends 20 formed in this way are engaged in openings 21 in the corresponding flange plate 1, and are retained on the outside of the flange plate 1, by means of a rod engaged through the loops 20, or by providing outwardly-projecting lugs on the flange plates 1, on which lugs the loops 20 are engaged.

According to the invention, the drum is provided with reinforcing and locking members extending axially inside the hub, and providing a resilient link tending to urge the flange plates towards each other.

Figure 2:
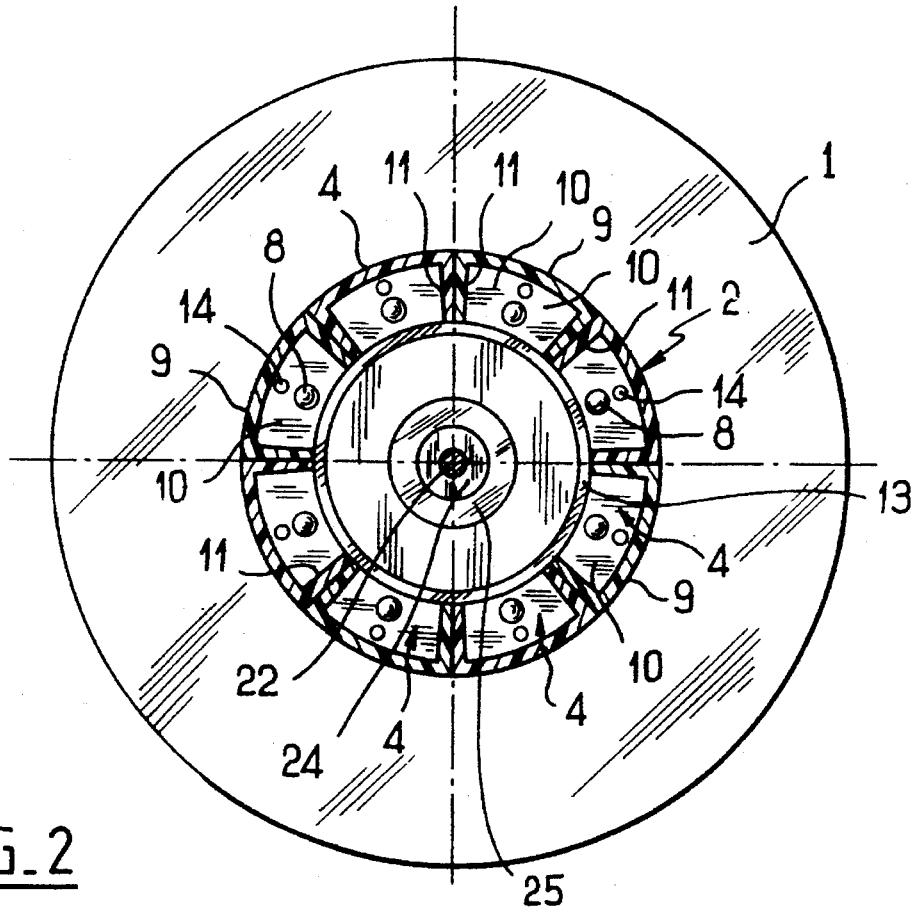
FIG. 2 is a section view on line II—II of FIG. 1.
Figure 8:
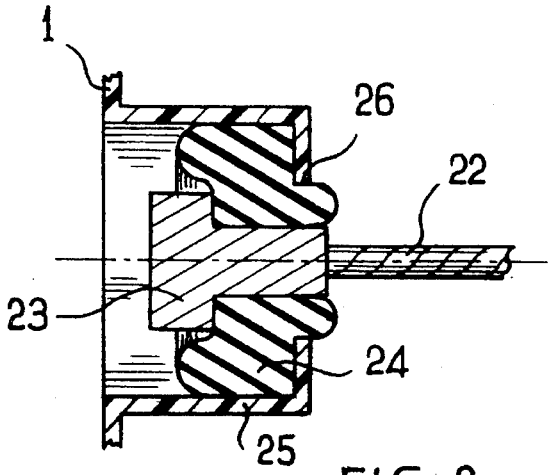
FIG. 8 is an enlarged view of the VIII of FIG. 7.
Figure 7:
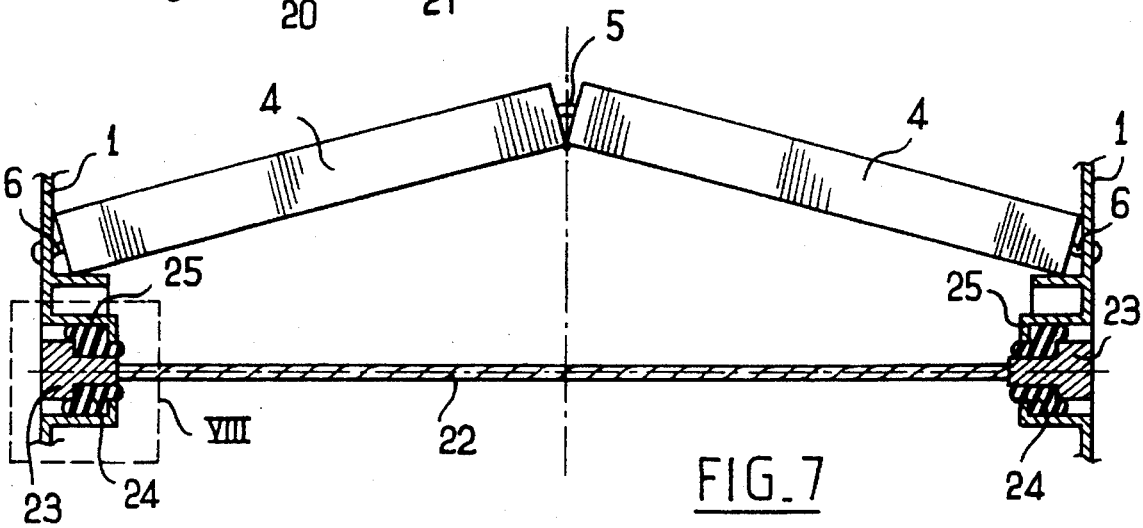
FIG. 7 is a fragmentary axial section view of a drum provided with a reinforcing and locking member for locking the drum in an intermediate position between the storage position and the in-use position.

In a first embodiment of the invention shown in FIGS. 2, 7, and 8, the reinforcing and locking members comprise steel cables 22 disposed axially inside the hub 2 and equipped with abutment pieces 23 which abut against annular buffers 24 made of rubber or of elastomer and disposed in cavities 25 provided in the flange plates 1. Preferably, the annular buffers 24 are of larger diameter than the abutment pieces 23.

The length of the cables 22 is chosen so that, when the drum is in the in-use position, the resilient buffers 24 are compressed by the abutment pieces 23 and the cable 22 is thus put under tension, thereby tending to urge the flange plates 1 towards each other, and thus to keep them pressed firmly against the corresponding ends of the portions 4. When the edge of either of the flanges 1 receives an impact, e.g. when the drum falls off a transport vehicle or off a platform so that it lands askew, the impact tends to separate one of the flange plates from the corresponding end of the hub 2, thereby putting increased tension on the cable 22. The increased tension is absorbed by the resilient buffers 24 which tend to urge the flange plate 1 back to its abutment position in which it abuts on the end of the hub, and which absorb a portion of the energy from the impact so that not all of that energy is transmitted to the resilient members 6.

Preferably, as shown in FIG. 8, the cavity 25 has an inside diameter that is substantially equal to the outside diameter of the resilient buffer 24, and the back of the cavity 25 is provided with an opening 26 having a size that is close to or greater than the size of the head 23 so that the buffer 24 can pass momentarily through the opening 26, thereby minimizing the traction stress to which the cable 22 is subjected.

Figure 9:
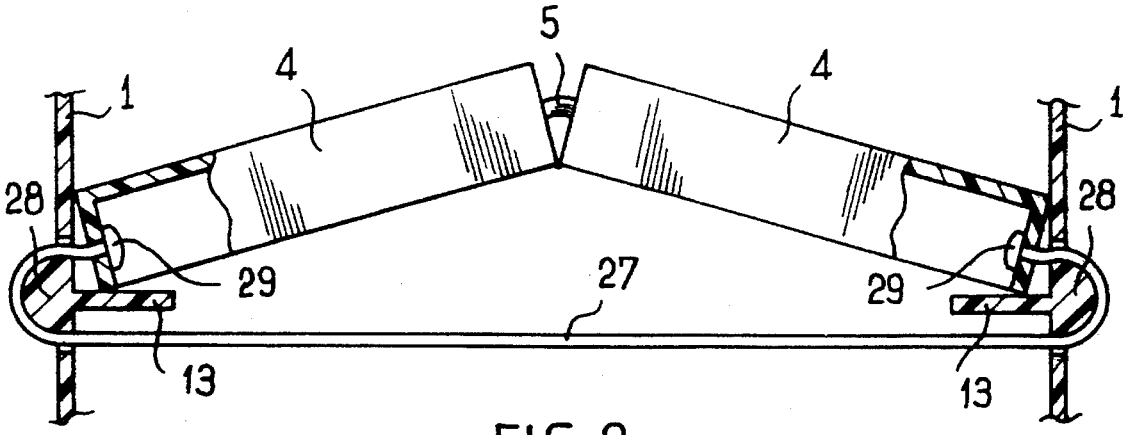
FIG. 9 is a view that is analogous to the FIG. 7 view, showing another embodiment of the reinforcing and locking member.

FIG. 9 shows another embodiment of this aspect of the invention in which the reinforcing and locking members simultaneously act as hinge means between the portions 4 and the flange plates 1. In this embodiment, the reinforcing and locking member is constituted by a cable having longitudinal resilience, e.g. a textile cable 27 which extends through the flange plates 1, which is folded back over respective annular beads 28, and which passes back through the flange plates 1 and through the end walls of the portions 4, the ends of the cable 27 being fixed by means of heads 29. For example, the heads 29 may be formed by tying knots in the ends of the cable 27, or by attaching heads 29 to the ends of the cable 27 by crimping.

In this embodiment, an impact on the flange plates that tends to urge them towards each other causes the hinged elements 3 to dip inwards until the facing ends of the portions 4 bear against the cable 27 which thus limits the deformation of the hinged elements, while ensuring that they are resiliently returned to a normal in-use position.

Naturally, the invention is not limited to the embodiments described, and variants may be made thereon without going beyond the ambit of the invention as defined by the claims.

In particular, although the first embodiment of the reinforcing and locking member is shown in the form of a single cable disposed along the axis of the drum, it is possible to provide a plurality of reinforcing and locking cables that are regularly distributed about the axis of the drum. Naturally in the embodiment shown in FIG. 9, it is necessary to provide as many cables 27 as there are hinged elements 3 making up the hub 2.

In the same way, although in the embodiment shown in FIG. 7 the resilient link member is shown in the form of a rubber buffer 24, it is possible to provide a resilient buffer made of any other material, e.g. made of knitted and compressed steel wire. It is also possible to fix the ends of the cable 22 to resilient disks, e.g. to the centers of spring steel disks having their outer edges engaged in the flange plates 1.

Although the drum of the invention is shown with hinge means that comprise resilient means, the invention is also applicable to hinge means that comprise hinges.

I claim:

1. A collapsible drum comprising flange plates associated with a hub made up of hinged elements, each of which comprises two portions having respective ends that face each other and that are connected together, and respective opposite ends that are connected to respective ones of the flange plates via hinge means disposed so that the portions of each of the hinged elements are substantially in alignment and are substantially perpendicular to the flange plates when the drum is in an in-use position, and so that the portions of each of the hinged elements are collapsed so that they extend along a direction that is substantially parallel to the flange plates when the drum is in a storage position, the portions of the hinged elements being provided with respective side surfaces disposed so as to touch one another in substantially radial planes of the hub when the drum is in the in-use position, wherein it is provided with at least one reinforcing and locking member extending axially inside the hub and providing a resilient link tending to urge the flange plates towards each other.

2. A collapsible drum according to claim 1, wherein the reinforcing and locking member comprises a resilient cable that is fixed to the ends of the portions of the hinged elements so also to act as hinge means between the portions of the hinged elements and the flange plates.

3. A collapsible drum according to claim 1, wherein the reinforcing and locking member comprises a cable connected to the flange plates via resilient link members.

4. A collapsible drum according to claim 3, wherein the reinforcing and locking member extends through holes in the flange plates and has ends that are provided with abutment pieces, and wherein the resilient link members comprise resilient annular buffers disposed between the abutment pieces and the flange plates.

5. A collapsible drum according to claim 4, wherein each of the resilient annular buffers has a diameter that is larger than the diameter of each of the abutment pieces, and wherein each of the through holes in the flange plates has a diameter that is close to or larger than the diameter of each of the abutment pieces.

6. A collapsible drum according to claim 5, wherein the flange plates are provided with cavities in which the resilient annular buffers are disposed, each of the buffers having an outside size that is substantially equal to the inside size of each of the cavities.

* * * * *